US005458061A

United States Patent [19]

Koura et al.

[11] Patent Number: 5,458,061

[45] Date of Patent: Oct. 17, 1995

[54] PRINTING PRESS

[75] Inventors: Kazuyuki Koura; Jiro Tanaka; Takuji Tsugawa, all of Mihara, Japan

[73] Assignee: Mitsubishi Jukogyo Kabushiki Kaisha, Tokyo, Japan

[21] Appl. No.: 242,321

[22] Filed: May 13, 1994

[51] Int. Cl.[6] ..... B41F 5/00

[52] U.S. Cl. ..... 101/216

[58] Field of Search ..... 29/244, 280, 282, 29/283; 101/212, 216, 152, 153, 375

[56] References Cited

U.S. PATENT DOCUMENTS

| | | | |
|---|---|---|---|
| 3,783,485 | 1/1974 | Nastasi | 29/201 |
| 3,789,757 | 2/1974 | Motter et al. | 101/216 |
| 4,007,982 | 2/1977 | Stange | 355/15 |
| 4,807,527 | 2/1989 | Knauer . | |
| 4,953,462 | 9/1990 | Krober | 101/216 |
| 5,188,027 | 2/1993 | Fantoni | 101/216 |
| 5,241,905 | 9/1993 | Guaraldi et al. | 101/216 |

FOREIGN PATENT DOCUMENTS

| | | |
|---|---|---|
| 0591792 | 4/1994 | European Pat. Off. . |
| 897107 | 11/1953 | Germany . |
| 4036389 | 5/1992 | Germany . |
| 4315909 | 12/1993 | Germany . |
| 4332364 | 4/1994 | Germany . |
| 4036391 | 5/1995 | Germany . |
| 63-207648 | 8/1988 | Japan . |

*Primary Examiner*—Ren Yan

[57] ABSTRACT

An apparatus for attaching and detaching bearings comprises a stand which is arranged in a position where the bearing for the printing cylinder is attached to and detached from the hole on a frame in a printing press, and which is, also, arranged movably on the side face of the frame of the printing unit. To this stand, there are connected an actuator for extracting the bearing, and a member for extracting the bearing, which engages with the bearing. An apparatus is arranged in a printing press for horizontally holding the printing cylinder which is supported by the other bearing in a cantilever fashion when either one of the bearings supporting the shafts on both sides of the printing cylinder is removed. For this apparatus, a device is arranged for thirsting up the shaft of the printing cylinder, and two bearings are mounted in the bearing on the side where the printing cylinder is held in a cantilever fashion, and then, the interval between these bearings is widened. An apparatus is arranged for providing a connecting shaft penetratingly in the cylinder of the printing cylinder rotatively supported through a pair of eccentric bearings on the left- and right-hand sides between a pair of frames on the left- and right-hand sides of a printing press, and each of the eccentric bearings is connected to the connecting shaft.

4 Claims, 8 Drawing Sheets

PRINTING PRESS

FIELD OF THE INVENTION AND RELATED ART STATEMENT

The present invention generally relates to a printing press.

A first aspect of the present invention relates to a bearing unit for the printing cylinders which are installed on a printing press. More particularly, it relates to an apparatus for attaching and detaching bearings to and from the shafts of printing cylinders.

At first, referring to FIG. 7, the description will be made of a conventional method for extracting a bearing for a printing cylinder of a printing press from the frame thereof.

The printing cylinder 2 is rotatively mounted on the frame 1 through the bearing 3. To extract the bearing 3 from the frame 1, a bearing extractor 4 is used. This extractor 4 comprises a threaded shaft 5, and a heavy movable piece 6 which is movably fitted onto the shaft 5. The threaded shaft 5 of the extractor 4 is screwed into the threaded hole 8*a* provided on the end face of the bearing 3, and then, the movable piece 6 is manually reciprocated in the axial direction of the threaded shaft 5. In this way, the movable piece 6 is caused to abut upon the head 7 of the extractor several times, hence extracting the bearing 3 from the hole 1*a* of the frame 1.

Also, as another method, a bolt 9 is screwed into a threaded hole 8*b*. By turning the bolt, the leading end of the bolt 9 is pressed onto the side face 1*b* of the frame 1 so that the bearing 3 is extracted from the hole 1*a* by the application of a reaction force thus exerted. The extracted bearing 3 is then carried manually to some other place.

Now, to insert the bearing 3 into the frame 1, the bearing 3 is manually fitted and pressed into the hole 1*a* while guiding it by means of the tapered section 3*a* provided for the outer periphery of the leading end of the bearing 3.

When the bearing 3 is extracted from and inserted into the hole of the frame 1 (hereinafter referred to as attaching and detaching), it has been required to use a tool manually as described above. In addition, the bearing 3 thus removed must be carried away to some other place.

A second aspect of the invention relates to an apparatus for holding a printing cylinder installed on a printing press, which is required for supporting the printing cylinder by use of the other bearing in a cantilever fashion when one of the two bearings forming a set, which support both ends of the printing cylinder, is removed.

To represent a conventional apparatus, a front view of an apparatus for holding a printing cylinder proposed in Japanese Patent Provisional Publication (KOKAI) No. SHO 63-207648/1988 is shown in FIG. 12. FIG. 13 is a view in which the apparatus shown in FIG. 12 is observed in the direction indicated by an arrow X therein.

In FIG. 12 and FIG. 13, reference numeral 1 designates a frame on one side; 2 the frame on the other side; 3 a printing cylinder; 4 the shaft of the printing cylinder 3 on one side; 5 the extended shaft of the printing cylinder 3 on the other side; 8 a driving gear; 9 a gear box formed integrally with the other frame 2; 9*a* and 9*b* the walls on both sides of the gear box 9; 10 an auxiliary shaft which is arranged to be attachable to and detachable from the extended shaft 5, and allowed to abut on the extended shaft 5 to be attached to and detached from the extended shaft; 11 a V-shaped ring groove which engages with the extended shaft 5; 16*a* and 16*b* eccentric shafts mounted on both ends of the auxiliary shaft 10, respectively; 21 a bearing on the side of the frame 1; and 22 a bearing on the side of the frame 2.

In order to remove the bearing 21, the auxiliary shaft 10 is rotated around the eccentric shafts 16*a* and 16*b* to shift the shaft 10 from a position in which the auxiliary shaft is away from the extended shaft 5 to the position in which the auxiliary shaft abuts on the extended shaft. After the auxiliary shaft 10 and the extended shaft 5 are brought into contact, the bearing 21 is extracted from the frame 1.

In this way, the printing cylinder 3 is supported by the bearing 22 and the auxiliary shaft 10 in a cantilever fashion. In this supporting state, a sleeve 12 is inserted through the bearing hole 6 provided on the frame 1 on one side. Then, subsequent to the sleeve being mounted on the printing cylinder 3, the bearing 21 is again inserted into the bearing hole 6. After fitting the bearing 21, the auxiliary shaft 10 is rotated around the eccentric shafts 16*a* and 16*b* in the direction opposite to the direction when the bearing was removed, thus shifting the auxiliary shaft to the position where it is away from the extended shaft 5.

However, there exist some problems associated with the above-mentioned conventional technique as given below.

When the printing cylinder 3 is supported in a cantilever fashion, a moment is exerted on the auxiliary shaft 10 to hold the printing cylinder with a substantial center of the width in the axial direction of the bearing 22 as its fulcrum. As a result, the rigidity of the gear box 9 must be increased considerably. The size of the gear box is made inevitably larger accordingly. The diameter of the extended shaft 5 of the printing cylinder must also be made greater.

Since the distance between the auxiliary shaft 10 and the bearing 22 is constant, there is a possibility that the shaft end of the printing cylinder 3 on the bearing 21 side is inclined due to the backlash of the bearing 22. In order to correct this inclination, the position for the auxiliary shaft 10 to contact the extended shaft 5 should be modified in accordance with the rotational angles of the eccentric shafts 16*a* and 16*b*.

In FIG. 13, reference numerals 13 and 14 designate fixing members mounted on the shaft 16*a*; 15 a stopper; 17 a fitting part; and 18 a bar fixed to the shaft 16*a*. Although the aforesaid contacting positions can be adjusted by rotating this fitting part 17, it is still difficult to minutely adjust the contacting positions. Therefore, when the bearing 21 is extracted from and inserted into the shaft, the operation must be carried out while lifting the position of the inclined shaft 4. However, since the load of the printing cylinder is applied to the bearing 21, the extracting and inserting operations are extremely difficult.

The present invention is designed in a view to solving the above-mentioned problems encountered in the conventional technique. The second aspect of the invention provides a mechanism for holding a printing cylinder, which is simply structured, and is capable of making a load applied to the shaft of the printing cylinder light, and also, making it easy to extract and insert the bearing.

A third aspect of the invention relates to an apparatus for interlocking a printing cylinder with eccentric bearings when the eccentric bearings are used as bearings for the printing cylinder.

In a conventional apparatus of the kind, a printing cylinder 3 is rotatively supported between a pair of frames 1*a* and 1*b* on the left- and right-hand sides through a pair of eccentric bearings 2*a* and 2*b* on the left- and right-hand sides as shown in FIG. 16, for example. On the eccentric bearings 2*a* and 2*b*, bearings 4*a* and 4*b* are mounted, respectively.

The rotational shafts 3*a* and 3*b* of the printing cylinder 3 are supported by these bearings.

The eccentric bearings 2*a* and 2*b* are rotatively fitted into the holes 6*a* and 6*b* which are arranged on the frames 1*a* and 1*b* for the eccentric bearings, respectively. On the eccentric bearings 2*a* and 2*b*, the first links 7*a* and 7*b* are installed, which are connected to the third links 10*a* and 10*b* through the second links 8*a* and 8*b*.

The third links 10*a* and 10*b* are mounted on a connecting rod 9. On the end portion of the connecting rod 9, an arm 11 is provided, which is connected to an actuator (not shown) in order to swing the arm 11. In this way, the holes 6*a* and 6*b* for the eccentric bearings are rotated so that the printing cylinder 3 can move eccentrically.

Nevertheless, the above-mentioned conventional technique has the following problems:

1) Whereas a space is needed in order to arrange the connecting rod, a plurality of links, and others in the vicinity of the printing cylinders, there are some cases that the required space cannot be obtained because of the various other apparatuses which should be arranged around the printing cylinders.

2) There is no arrangement of any function to adjust the rotational phases of each of the bearings either on the eccentric bearing 4*a* side or on the eccentric bearing 4*b* side. Therefore, the machining and assembling of the parts forming the system must be done with a sufficiently high precision.

3) Because the number of parts is large, not only the material cost is high, a considerable time is taken to assemble them, making a cost higher still inevitably.

4) In a printing unit in which the eccentric bearing which supports either one of the shafts of the printing cylinder is extracted, and then, a cylindrical printing member such as a form plate and a blanket is inserted into the printing cylinder through the hole of the frame from which the eccentric bearing has been extracted, the above-mentioned plural links stand in the way to make it impossible for such printing members to be inserted.

OBJECT AND SUMMARY OF THE INVENTION

It is an object of the present invention to improve each of parts of a printing press and provide a printing press whose performance is enhanced as a whole.

The object of the first aspect of the invention is to provide an apparatus for attaching and detaching a bearing, which does not require any manual work and tool for assembling and dissembling, and also, makes it unnecessary to carry away the extracted bearing to some other place.

In order to achieve this object, an apparatus according to the first aspect of the present invention has a stand installed on the side end (that is, the side where the bearing is arranged) of the frame of a printing press; on this stand, there are arranged an actuator for extracting the bearing, and a member for extracting the bearing, which engages with the bearing of the aforesaid printing cylinder; and then, the stand is arranged to be movable.

To extract the bearing, the stand is carried to a position facing the bearing. The bearing is extracted by means of the actuator for extracting the bearing after the member for extracting the bearing is hooked to the flange or the groove of the bearing. Then the stand is carried to a location where it is on the standby together with the extracted bearing which is held on the stand as it is by the member for extracting the bearing.

The object of the second aspect of the invention is to provide an apparatus for holding a printing cylinder in a cantilever fashion when a bearing is removed at either end of the shaft of the printing cylinder from those supporting the printing cylinder shaft at opposite ends.

In order to achieve this object, the following arrangement is made according to the second aspect of the invention:

(1) An apparatus is structured so that the printing cylinder can be supported only at one of the two sets of bearing supports arranged for the opposite ends of the printing cylinder without allowing the printing cylinder to incline its axis. For example, the two bearings to be mounted on the above bearing support (called the supporting side support) are arranged at a wider interval.

(2) A thrusting device is provided for the shaft of the printing cylinder near the aforesaid supporting side support for thrusting the shaft upward.

(3) A thrusting device is provided on the other side (called the removal side) for thrusting the shaft upward.

In this respect, when the above-mentioned structure (1) is adopted, it is possible to hold, by means of the aforesaid bearing support and bearing, the printing cylinder in a cantilever fashion by widening the supporting span between the bearings on the bearing support on the supporting side. In this case, however, it is necessary to use bearings each having an excellent precision and a small backlash.

Also, when the structure (2) is adopted, the printing cylinder is thrusted upward by the device arranged for the purpose. Thus its dead load can be offset, and the load exerted on the bearing on the removal side becomes almost zero. As a result, the force needed when extracting and inserting the bearing is extremely small even if the position of the shaft end is slightly displaced on the bearing removal side.

By adopting the structure (3), the force needed to offset the dead load of the printing cylinder can be small. It is possible to anticipate the miniaturization of the device for thrusting the printing cylinder upward.

The object of the third aspect of the invention is to provide an improved interlocking mechanism for the eccentric bearings.

To achieve this object, a mechanism according to the third aspect of the invention comprises a connecting shaft penetrating the interior of the printing cylinder which is rotatively supported between a pair of frames on the left- and right-hand sides through a pair of eccentric bearing arranged on the left- and right-hand sides, respectively, and then, each of the aforesaid eccentric bearings is connected to the connecting shaft.

Further, according to the present invention, a device for adjusting the rotational phases is provided for each of the connections between the aforesaid eccentric bearings and the connecting shaft.

According to the present invention, the eccentric bearings, which support both shafts of the printing cylinder, respectively, are mounted at the same eccentric phase on the connecting shaft penetrating the interior of the printing cylinder. As a result, when the connecting shaft rotates, both of the eccentric bearings rotate while keeping the same eccentric phase. Also, the adjustment of the standard position can be made by means of an elongated hole which is arranged on the link in order to allow the connected shaft to rotate, and a stopper for setting the shift position, for example. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2(*b*) is a plan view showing the bearing;

DETAILED DESCRIPTION OF THE PREFERRED EMBODIMENTS

Hereinafter, the description will be made of the first aspect of the invention with reference to the accompanying drawings showing the embodiments thereof.

Figure 1:
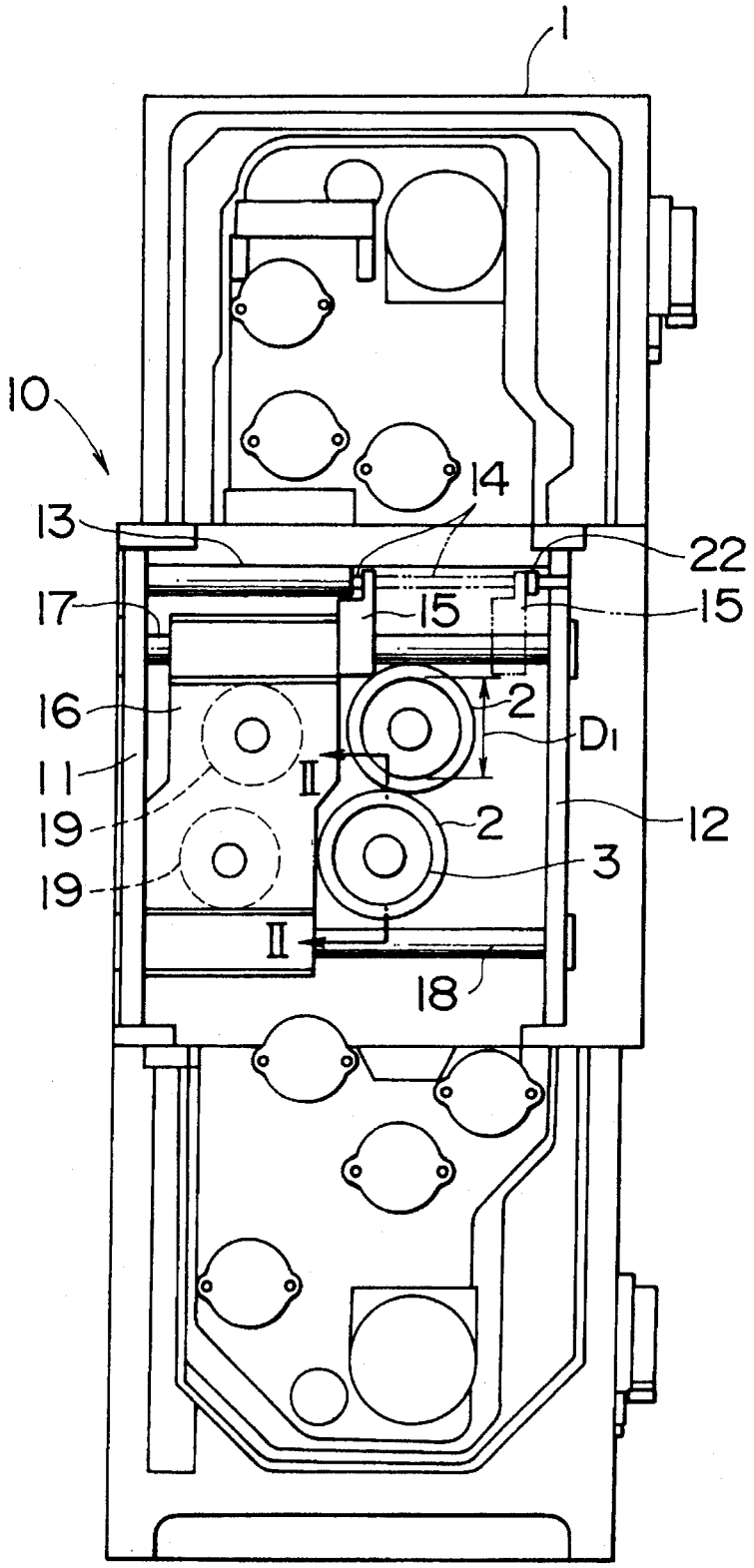
FIG. 1 is a side view showing a printing unit having an apparatus for attaching and detaching a bearing according to the first aspect of the present invention.
Figure 2A:
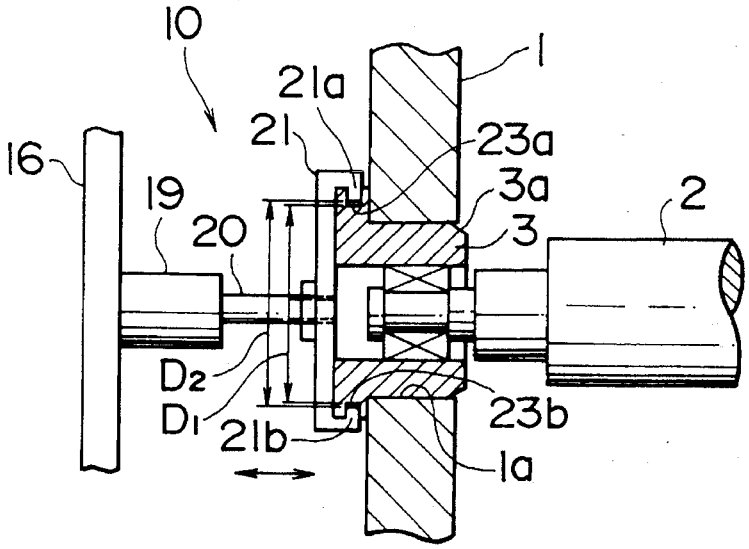
FIG. 2(*a*) is an exploded sectional view showing a first embodiment of means for removing and inserting a bearing for an apparatus for attaching and detaching a bearing according to the present invention, taken along line II—II in FIG. 1.
Figure 2B:
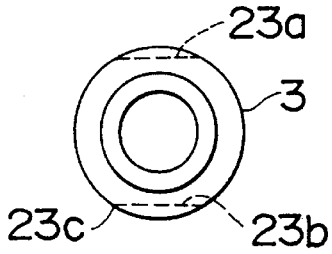

In FIG. 1 and FIG. 2, an apparatus 10 for attaching and detaching a bearing comprises a pair of brackets 11 and 12 extruding outwardly, which are fixed to the side end of a frame 1 of a printing unit (its front view is omitted; only the side view is shown); an actuator 13 (in FIG. 1, an air cylinder is used) which is fixed to the bracket 11; an output shaft 14 of the actuator 13; a connecting piece 15 mounted on the output shaft 14 movably in the axial direction; a stand 16 having the connecting piece 15 mounted thereon; and bars 17 and 18 for guiding the stand 16 in the axial direction of the output shaft 14.

On the stand 16, actuators 19 and 19 (In FIG. 2(*a*), air cylinders) are mounted for extracting the bearing. To the threaded part of the leading end of the output shaft 20 of each of the actuators 19, a member 21 for extracting the bearing is fitted by means of a screw. A reference numeral 22 designates a stopper. With this, the extruded position of the output shaft 14 can be adjusted.

Figure 5:
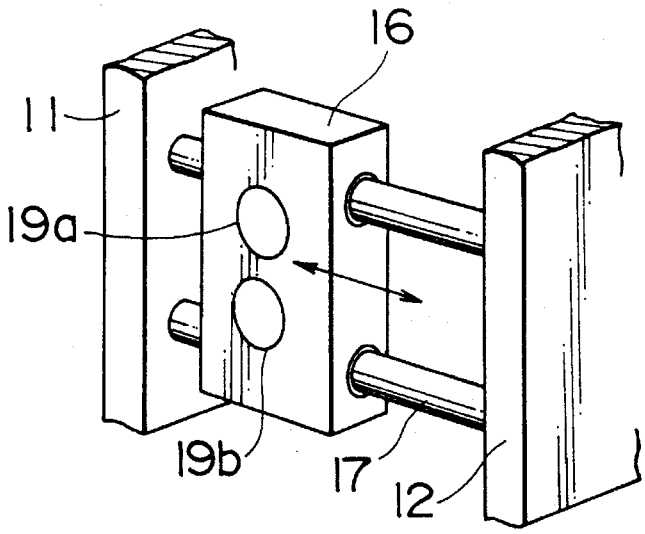
FIG. 5 is a perspective view showing the supporting structure of a stand which performs a parallel shift.
Figure 6:
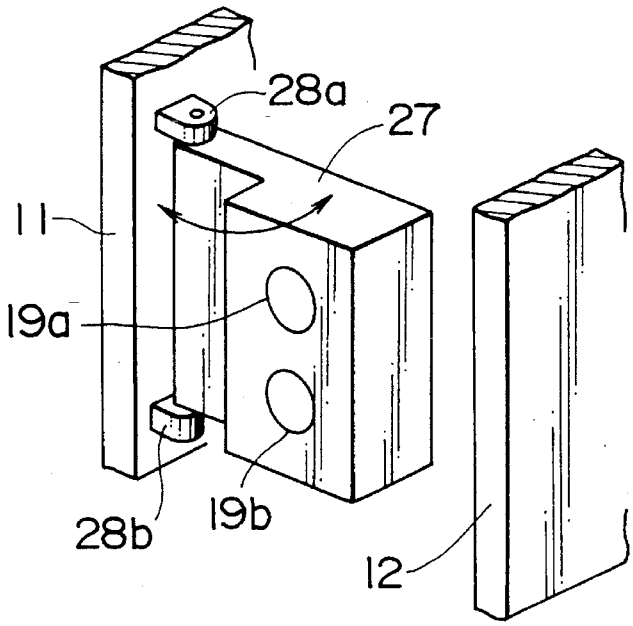
FIG. 6 is a perspective view showing a supporting structure for a stand which is movable in circle.
Figure 7:
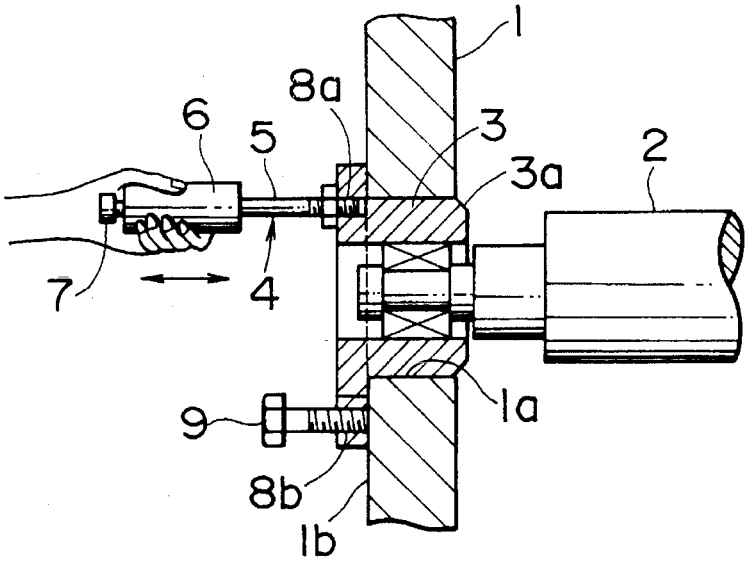
FIG. 7 RELATED ART
FIG. 7 is a cross-sectional view illustrating a conventional method for extracting a bearing.

As shown in FIG. 5, the connecting piece 15 and the stand 16 reciprocate by means of an actuator 13 between a standby position (indicated by solid lines in FIG. 1) and a position for attaching and detaching the bearing (indicated by dotted lines in FIG. 1. Only the connecting piece 15 is indicated). Also, the shift between the standby position and the position for attaching and detaching the bearing may be made in a circular movement as shown in FIG. 6. In FIG. 6, a reference numeral 27 designates a rotary stand, and 28*a* and 28*b*, the supporting hinges which connect the upper and lower parts of the stand 27 on one side rotatively to a bracket 11.

In FIG. 1 and FIG. 2, the stand 16 shifts to the position for attaching and detaching the bearing (indicated by dotted lines). The member 21 and 21 for extracting the bearing engage with the bearing 3 and 3. The stopper 22 suspends the shift of the stand. In this position, the actuators 19 and 19 each mounted on the stand 16 are actuated for extracting the bearing in order to attach and detach the bearing 3 of the upper printing cylinder 2 and the bearing 3 of the lower printing cylinder 2 to and from the hole 1*a* of the frame 1.

In other words, for each of the bearings 3, grooves 23*a* and 23*b* are arranged in parallel in the axial direction of the two guide bars 17 and 17 arranged vertically. The leading portions 21*a* and 21*b* of the hooks of the member 21 for extracting the bearing are fitted into the above-mentioned grooves 23*a* and 23*b*. The clearance between the space $D_1$ formed by the grooves 23*a* and 23*b*, and the space $D_2$ formed by the leading ends 21*a* and 21*b* is extremely small (see FIG. 2).

In this respect, for the end of the parallel groove 23*b* on the side where the member 21 for extracting the bearing advances, a diagonally cut-off portion 23*c* is provided to make the insertion of the member 21 easy.

As described above, by means of the stopper 22 on the output shaft 14, a position in the axial direction, or the horizontal direction, is regulated, while by means of the vertically parallel grooves 23*a* and 23*b*, a position in the vertical direction is regulated. Therefore, in the position for attaching and detaching the bearing, the actuators 19 and 19 are arranged almost coaxially with the vertically positioned bearings 3 and 3. Thus the bearings 3 and 3 can be extracted and inserted smoothly by the operation of the actuators.

The bearings 3 extracted by the actuators 19 are carried to the standby position (indicated by the solid lines in FIG. 1) together with the stand 16, hence releasing the front end of the hole 1*a* of the frame 1 where the bearings 3 of the printing cylinders 2 are inserted. Then the replacement of cylindrical form plates, or blankets, removal of printing cylinders, adjustment of impression pressure, inspection and maintenance, and other operations are executed.

The extracted bearings 3 are held together with the members 21 for extracting the bearing on the standby position coaxially with them.

FIG. 2(*a*) is an exploded view showing the state in which the stand 16, the actuator 19 for extracting the bearing, which is fixed to the stand, the member 21 for extracting the bearing, which is movable in the horizontal direction (direction indicated by arrows) by the actuator, and the leading ends 21*a* and 21*b* of the member 21 are coupled with the upper and lower grooves 23*a* and 23*b* of the bearing 3.

FIG. 2(*b*) is a plan view of the bearing 3.

Figure 3:
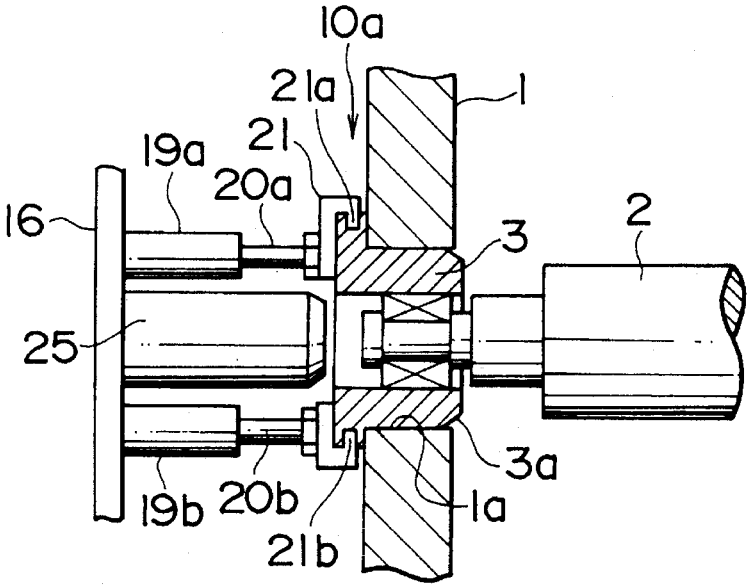
FIG. 3 is an exploded sectional view showing a second embodiment of an apparatus for attaching and detaching a bearing according to the present invention, taken along line II—II in FIG. 1.
Figure 4:
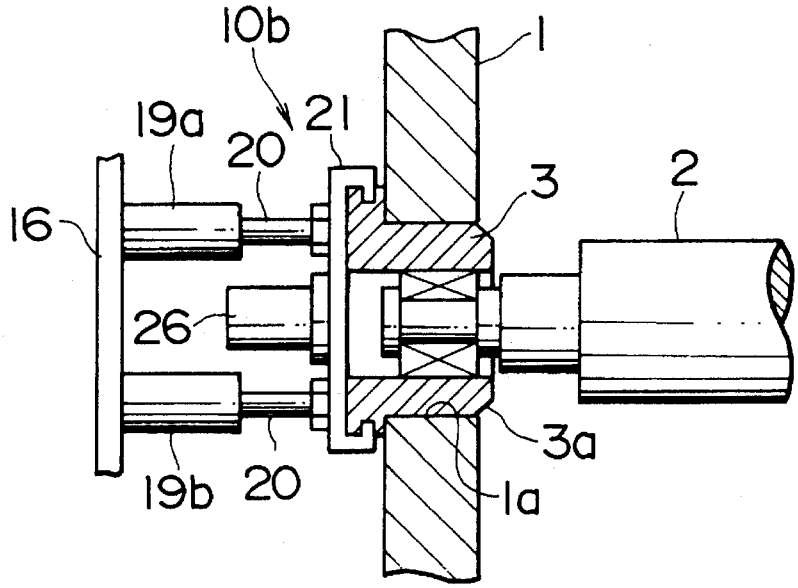
FIG. 4 is an exploded sectional view showing a third embodiment of an apparatus for attaching and detaching a bearing according to the present invention, taken along line II—II in FIG. 1.

FIG. 3 and FIG. 4 are views each showing another embodiment of an apparatus for attaching and detaching the bearing.

For the apparatus 10*a* for attaching and detaching the bearing shown in FIG. 3, a plurality of actuators 19*a* and 19*b* for extracting the bearing are arranged.

On the output shafts 20*a* and 20*b* of these actuators 19*a* and 19*b*, members 21 and 21 for extracting the bearing are mounted. Here, reference numerals 21*a* and 21*b* designate the leading ends of the members, respectively. In the present embodiment, a guide 25 for supporting the bearing, whose diameter is slightly smaller than the inner diameter of the bearing 3, is fixed to the stand 16. This is the difference in the present embodiment from the apparatus 10 for attaching and detaching the bearing shown in FIG. 2A.

In operating the removal of the bearing, the extracted bearing 3 is shifted to fit in the guide 25 for supporting the bearing. Since the guide 25 bears the weight of the bearing 3, the member 21 for extracting the bearing can move smoothly. Also, in operating the insertion of the bearing, the guide 25 for supporting the bearing holds it almost coaxially with the hole 1*a* of the frame 1 for inserting it, and also, holds the bearing 3 in the direction orthogonal to the axis of the hole 1*a*. As a result, the bearing 3 can easily be inserted without any complication.

In the apparatus 10*b* for attaching and detaching the bearing in FIG. 4, what differs from the apparatus 10 shown in FIG. 2 is that a plurality of actuators 19*a* and 19*b* are arranged for extracting the bearing, and that a member 21 for extracting the bearing is arranged, which is supported by the output shafts 20 of these actuators 19, and at the same time, a vibrator 26 is provided and fixed to the member 21 for extracting the bearing.

The vibrator 26 gives fine vibrations in the direction of bearing extraction. The fine vibrations are propagated to the bearing 3 to make its attachment and detachment easy. Particularly when the bearing is inserted, the fine vibrations thus propagated eliminate any complication that may occur on the bearing 3, and facilitate its insertion. In this respect, it may be possible to arrange the actuators 19*a* and 19*b* for extracting the bearing to be vibrated without any individual provision of the vibrator 26. Also, the vibrator 26 and the guide 25 for supporting the bearing may be arranged side by side.

According to the above-mentioned invention, the member for extracting the bearing, which is hooked onto the bearing, is allowed by the operation of the actuators for extracting the bearing to reciprocate in the direction of extraction, and then, the member for extracting the bearing and the hole for fitting the bearing are positioned in order to align the member and the hole coaxially. In this way, the extraction and insertion of the bearing are automatically executed smoothly.

Also, by allowing the stand which holds the member for extracting the bearing to reciprocate between the standby position and the position for attaching and detaching the bearing, the extracted bearing is held at the standby position for storage. Unlike the prior art, therefore, there is no need for the extracted bearing to be carried to some other place for storage.

When the stand is in the standby position, the front end of the hole on the frame where the bearing is inserted is released to make it easy to operate the installation of the cylindrical form plate, blanket, or the like. Also, the additional provision of the guide for supporting the bearing and the vibrator enables the attachment and detachment of the bearing to be executed more smoothly and easily.

Now, in conjunction with FIG. 8 to FIG. 11, the description will be made of embodiments according to the second aspect of the invention.

Figure 8:
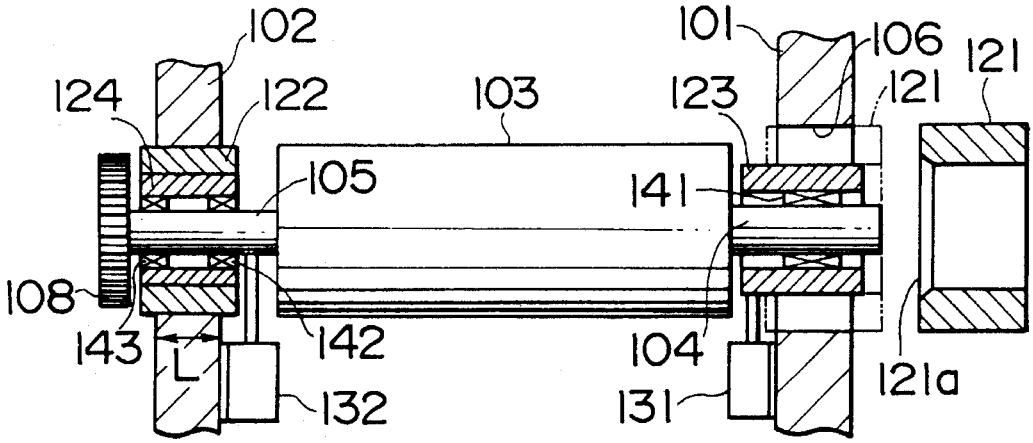
FIG. 8 is a partially sectional front view showing an apparatus for holding a printing cylinder in an embodiment according to the second aspect of the present invention.
Figure 12:
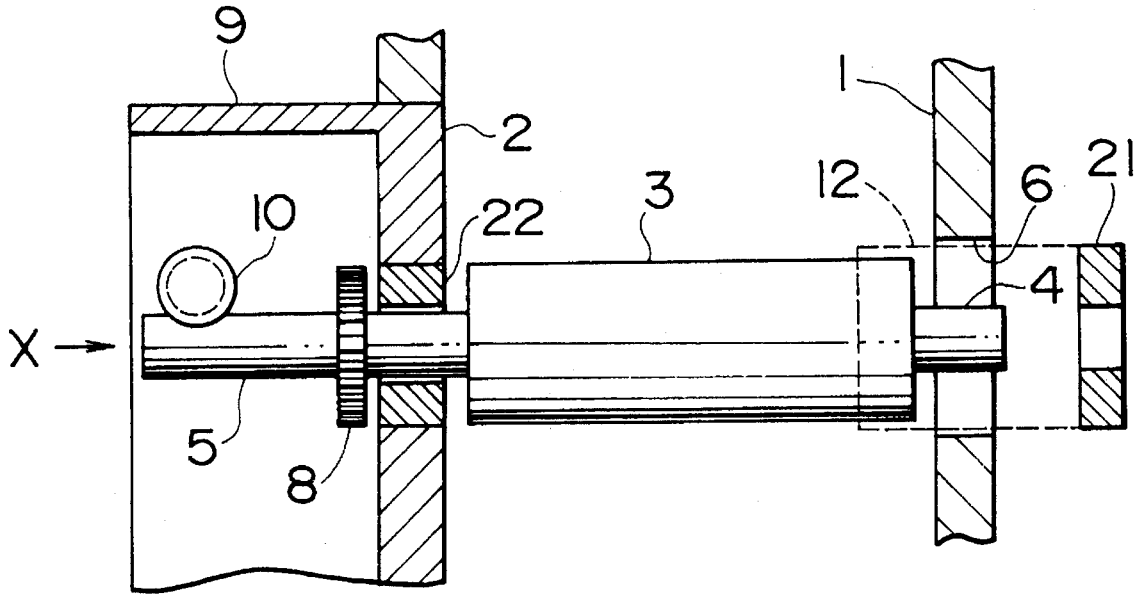
FIG. 12 RELATED ART
FIG. 12 is a partially sectional front view showing a conventional apparatus for holding a printing cylinder.
Figure 13:
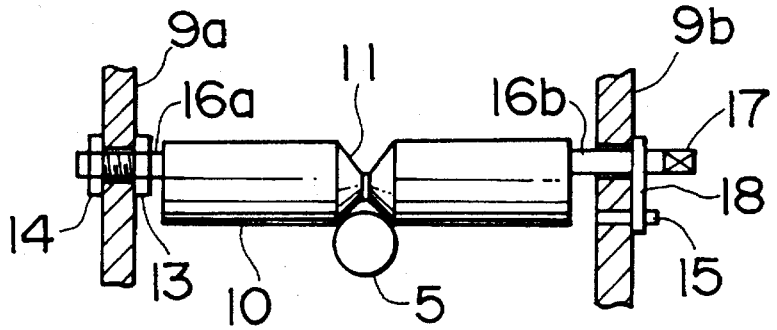
FIG. 13 RELATED ART
FIG. 13 is a side view of the apparatus shown in FIG. 12, observed in the direction X.

In FIG. 8, reference numerals 101 and 102 designate frames in the same way as FIG. 12; 103 a printing cylinder; 104 and 105 the shafts of the printing cylinder; 108 a driving gear fixed to the shaft 105; 121 and 122 outer bearing sleeve; and 123, and 124 inner bearing sleeve on the inner side. On the inner bearing sleeve 124 on the supporting side of cantilever type (driving side), bearings 142 and 143 are mounted at an interval L.

When the outer bearing sleeve 121 is extracted from the shaft 104 on the opposite side (the side where the bearing can be removed) of the printing cylinder 103, the aforesaid bearings 142 and 143 support the printing cylinder 103 in a cantilever fashion. Also, thrust-up devices 131 and 132 are arranged on the inner sides of the frame 101 and 102, respectively. The inner bearing sleeve 123 is supported by the thrust-up device 131, and the shaft 105 is supported by the thrust-up device 132.

Figure 9:
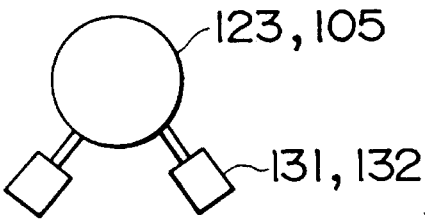
FIG. 9 is a view showing an example of the arrangement of the thrust up device shown in FIG. 8.
Figure 10:
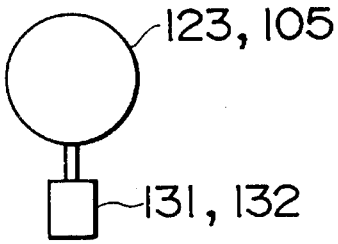
FIG. 10 is a view showing another example of the arrangement of the thrust up device shown in FIG. 8.
Figure 11:
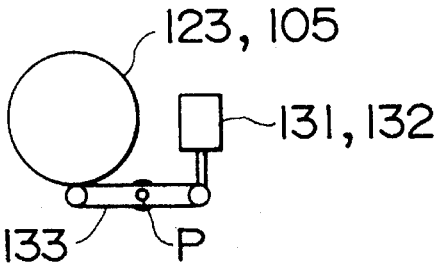
FIG. 11 is a view showing still another example of the arrangement of the thrust-up device shown in FIG. 8.

FIG. 9 to FIG. 11 are views showing examples for arrangements of the thrust-up device 131 for the inner bearing sleeve 123 or the thrust-up device 132 for the shaft 105, respectively.

Depending on the way in which each of the members is arranged on the circumference of the inner bearing sleeve 123 or the shaft 105, the bearing sleeve or the shaft mentioned above is thrusted up diagonally from under by a set of the thrust-up devices 131 or 132 (see FIG. 9); the bearing sleeve or the shaft is thrusted up directly from under by a set of the thrust-up devices 131 or 132 (see FIG. 10); or the bearing sleeve or the shaft is thrusted up by the thrust-up device 131 or 132 through a swing lever 133 around a pivot P (see FIG. 11). Any one of these arrangements can be selected for use.

In this respect, the shaft 104 may be thrusted up by the thrust-up device 131. Holding the shaft 104 or 105 of the printing cylinder 103 by means of the thrust-up device 131 or 132 makes it possible to offset the load of the printing cylinder 103 which is exerted on the shaft 104. Thus, the load becomes zero.

Therefore, even if the position of the leading end of the shaft 104 is displaced slightly, it is possible to allow the leading end of the shaft 104 to move easily to the position where it is aligned with the bearing hole 106 of the frame 101 by means of the tapering surface 121*a* provided for the inserting side of the bearing sleeve 121. In this way, the extraction and insertion of the bearing sleeve 121 can be executed smoothly and easily. In this respect, the thrust-up devices 131 and 132 are those which exert the required thrusting-up force by the application of hydraulic or pneumatic pressure or by means of springs.

In addition to the thrust-up device 131 which can hold the shaft 104 so that no load is exerted on its leading end, the interval L between the bearings 142 and 143 is widened, hence making it possible to hold the position of the leading end of the shaft 104 coaxially with the bearing hold 106 more easily.

In the apparatus for holding a printing cylinder horizontally by use of the other bearing sleeve and bearings in a cantilever fashion when removing either one of the bearings or bearing sleeves which support the shafts on the opposite sides of the printing cylinder, an apparatus for holding a printing cylinder according to the above-mentioned invention is capable of extracting and inserting the removed bearing sleeve extremely smoothly by arranging on the printing cylinder side a device for trusting up the aforesaid shaft for the aforesaid bearing in order to eliminate the exertion of any load on the leading end of the shaft of the printing cylinder on the bearing side.

Also, in the bearing sleeve on the side for supporting the printing cylinder in a cantilever fashion, two bearings are provided, and further, the interval of these bearings is widened, thus making it easier to hole the printing cylinder horizontally than the conventional apparatus when the bearing on the opposite side is removed. In this way, the gear box can be made smaller.

Figure 14:
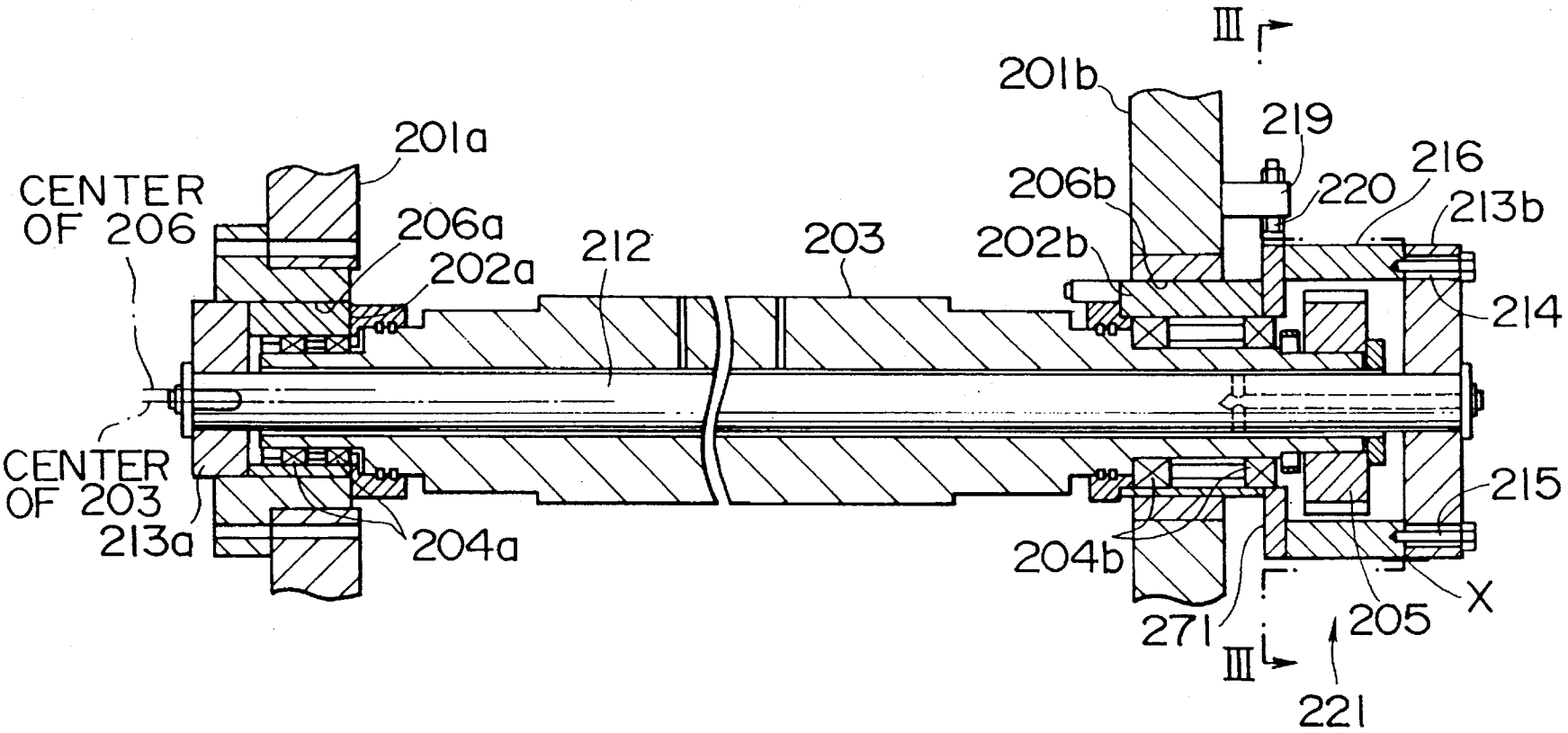
FIG. 14 is a cross-sectional view of another embodiment of a printing cylinder according to the third aspect of the present invention, taken along the axis thereof.

Now, in conjunction with FIG. 14 and FIG. 15, the description will be made of an embodiment according to the third invention.

A reference numeral 203 designates a printing cylinder. The shafts formed on both ends of the printing cylinder 203 are supported by eccentric bearings 202*a* and 202*b* through bearings 204*a* and 204*b*.

The eccentric bearings 202*a* and 202*b* are rotatively inserted into the holes 206*a* and 206*b* on a pair of frames 201*a* and 201*b* on the left- and right-hand sides, which are arranged for holding the eccentric bearings, respectively.

A connecting shaft 212 is penetratingly arranged in the cylinder of the printing cylinder 203. On both ends of the connecting shaft 212, a link 213*a* and a link 213*b* are mounted. The link 213*a* is fixed to the eccentric bearing 202*a*. The link 213*b* is fixed to the link 217 through a spacer 216. On both ends of the link 217, elongated adjustment holes 214 are provided. Bolts 215 are inserted into the adjustment holes 214.

The bolts 215 are set from the link 213*b* into the spacer 216 by meas of the threaded holes prepared thereon, respectively.

The link 217 is fixed to the eccentric bearing 202*b*. Thus the link 217 and the link 213*a* are installed on the eccentric bearings 202*b* and 202*a* at the same eccentric phase. Further, to the link 217, a link 208, which is movable in the direction indicated by an arrow A by an actuator (not shown), is connected as shown in FIG. 15. Between the link 217 and the link 213*b*, a driving gear 205 is fixed to the printing cylinder 203.

Also, on the frame 201*b*, an adjustable stopper 220 is provided. The stopper can abut on the side face 217*a* of the link 217 through the bracket 219 which is fixed to the frame. A system 221 for adjusting the phases are formed by the aforesaid link 213*b*, adjustment holes 214, bolts 215, link 217, and stopper 220.

When the link 208 is actuated in this manner, the eccentric bearing 202*b* rotates by means of the link 217. Also, since the eccentric bearing 202*a* moves eccentrically in one way through the link 217, spacer 216, link 213*b*, connecting shaft 212, and link 213*a*, these eccentric bearings 202*a* and 202*b* are allowed to shift to the position of the same eccentric phase at a time.

Now, the adjustment of the fiducial point is executed by the link 213*b*, adjustment holes 214, bolts 215, stopper 220, and link 217, which form the system 221 for adjusting the phases.

The stopper 220 is coupled to the bracket 219 by means of a screw, and then, by adjusting the position of the stopper 220 extruding from the bracket, it is possible to adjust the rotational position of the link 217.

Figure 15:
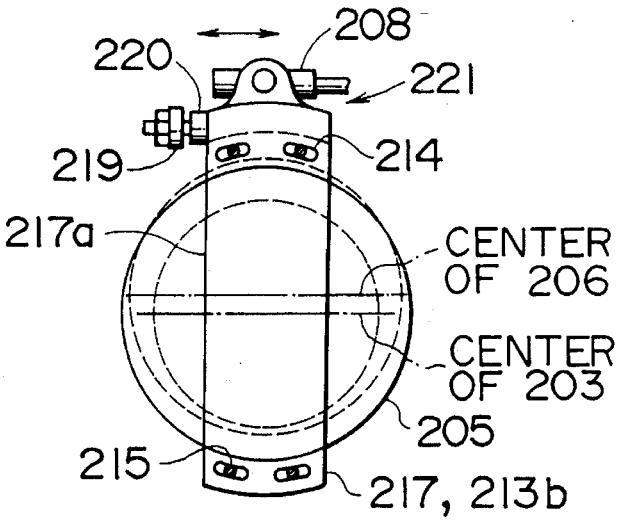
FIG. 15 is a view showing the printing cylinder shown in FIG. 14, taken along line III—III and observed in the direction indicated by arrows.
Figure 16:
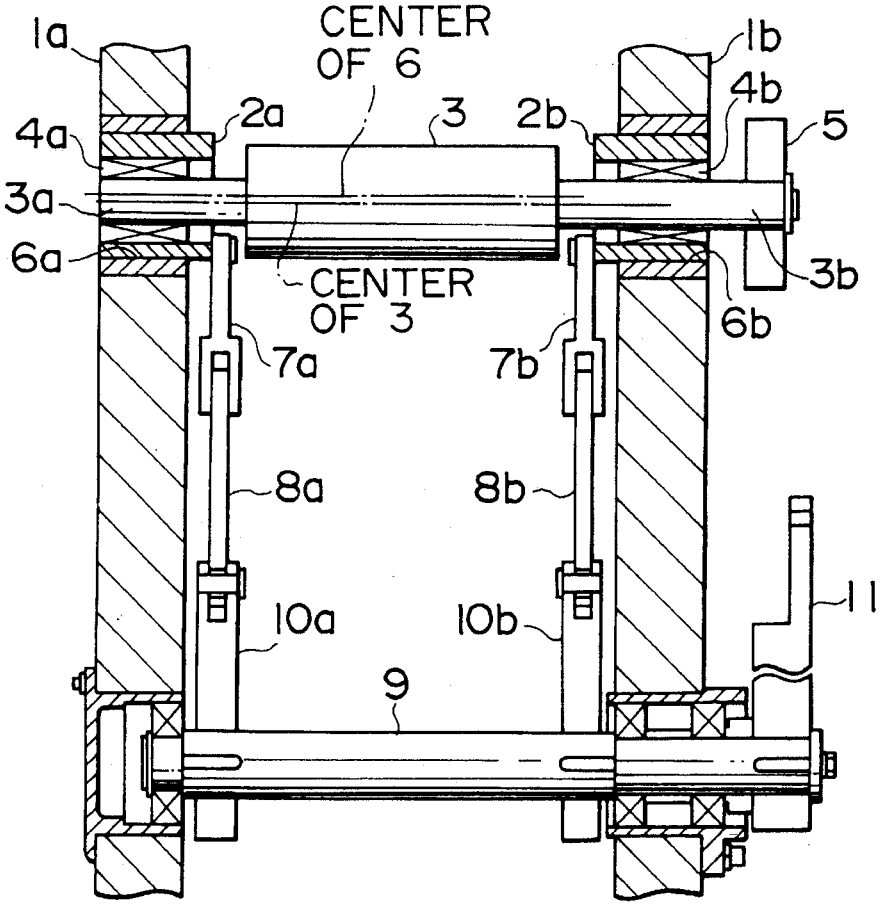
FIG. 16 is a partially sectional front view showing a conventional example.

If, for example, the printing cylinder 203 should take the position of its fiducial point at the lowest location (indicated by broken line) in FIG. 15, such a position is set in advance in order to allow the side face 217*a* of the link 217 to abut upon the stopper 220.

Then the bolts 215 are untightened to make the spacer 216 and the link 213*b* free. In this state, the link 208 is moved to adjust the position of the eccentric bearing 202*b*. In other words, the side face 217*a* of the link 217 is allowed to abut upon the stopper 220, and then, the bolts 215 are tightened.

At this juncture, the fiducial lines X inscribed on the peripheries of the link 213*b* and the spacer 216 to set them aligned each other (or means similar to it) may sometimes be displaced. In such a case, the link 213*b* is turned to return it until the fiducial lines X are aligned. The eccentric bearing 202*a* is then set in the correct fiducial position. When the eccentric bearings 202*a* and 202*b* are both set in the fiducial positions, the bolt 215*a* is tightened to fix the spacer 216 and the link 213*b*.

According to the above-mentioned invention, the connecting shaft is allowed to penetrate the interior of the printing cylinder, and the eccentric bearings are coupled to this connecting shaft. Therefore, the eccentric bearings can be rotated at the same eccentric phase simultaneously, and also, in the vicinity of the printing cylinder there is no need for the provision of any connecting shaft, links, and other members required to interlock the eccentric bearings as in the conventional technique. Therefore, it is possible to save the space around the printing cylinders, and at the same time, reduce the number of parts, thus implementing a significant cost reduction.

Also, the system is formed for the phase adjustment to make it possible to match the rotational phases of the eccentric bearings on the operation and driving sides. Also, with the adjustment where the link abuts upon the stopper, it is possible to set the position of eccentricity exactly at the position of the predetermined fiducial point.

Further, in a state that one of the eccentric bearings is extracted, a cylindrical form plate or blanket can be inserted into the printing cylinder from the hole on the frame after the eccentric bearing is extracted.

We claim:

1. An apparatus for attaching and detaching a bearing for a printing cylinder, comprising:

a printing press frame having a hole in which a bearing is mounted, said bearing provided for supporting an axial end of a printing cylinder;

a stand movably installed on a side face of said printing press frame;

an extracting member for extracting the bearing, said extracting member being engaged with the bearing;

a first actuator for moving said extracting member in an axial direction of the hole to extract said bearing, said first actuator being mounted to the stand; and a second actuator for moving said stand away from an axial end of said printing cylinder.

2. The apparatus for attaching and detaching a bearing according to claim 1, further comprising a guide for supporting the bearing having an outer diameter slightly smaller than the inner diameter of said bearing, wherein said guide is mounted on said stand.

3. The apparatus for attaching and detaching a bearing according to claim 1, further comprising vibrator means for extracting the bearing.

4. The apparatus for attaching and detaching a bearing according to claim 1, further comprising a vibrator attached to said extracting member.

* * * * *